United States Patent [19]

Plume

[11] 4,435,819

[45] Mar. 6, 1984

[54] ELECTRICAL RESISTANCE FURNACES

[75] Inventor: Alan W. Plume, Weybridge, England

[73] Assignee: A. W. Plume Limited, England

[21] Appl. No.: 359,580

[22] Filed: Mar. 18, 1982

[30] Foreign Application Priority Data

Mar. 18, 1981 [GB] United Kingdom ..... 8108444

[51] Int. Cl.[3] ..... H05B 3/06

[52] U.S. Cl. ..... 373/119; 373/130; 373/133; 373/125; 373/137

[58] Field of Search ..... 373/119, 133, 125, 130, 373/137

[56] References Cited

U.S. PATENT DOCUMENTS 2,969,412 1/1961 Frank ..... 373/133

4,238,635 12/1980 Saarivirta et al. ..... 373/119

*Primary Examiner*—Roy Envall

*Attorney, Agent, or Firm*—Hayes, Davis & Soloway

[57] ABSTRACT

An electrical resistance furnace which includes a number of electrical resistance heating elements arranged around the sides and surrounding a space containing a crucible or similar container to be heated, the elements being supported at least at their ends by fire-brick material and being surrounded by heat insulation, wherein both ends of each resistance element extend through apertures in the fire-brick material so that by removing part of the heat insulation access may be gained to both ends of the element from the exterior of the furnace to permit removal and repair or replacement of the element.

3 Claims, 4 Drawing Figures

ELECTRICAL RESISTANCE FURNACES

ELECTRICAL RESISTANCE FURNACES

This invention relates to electrical resistance furnaces of the type which include a number of electrical resistance heating elements arranged around a space for a crucible or similar container to be heated, the elements being surrounded by fire-brick material which in turn is surrounded by various forms of heat insulation and usually an external metal casing is provided around the heat insulation.

One difficulty encountered with such furnaces is that when it becomes necessary to replace a faulty heating element a considerable delay, possibly a matter of days, is encountered due to the need to let the furnace cool before access can be gained to the element in the interior space.

It is an object of the present invention to alleviate this difficulty.

The present invention consists in an electrical resistance furnace which includes a number of electrical resistance heating elements arranged around the sides and surrounding a space containing a crucible or similar container to be heated, the elements being supported at least at their ends by fire-brick material and being surrounded by heat insulation, wherein both ends of each resistance element extend through apertures in the fire-brick material so that by removing part of the heat insulation access may be gained to both ends of each element from the exterior of the furnace to permit removal and repair or replacement of the element.

Figure 1:
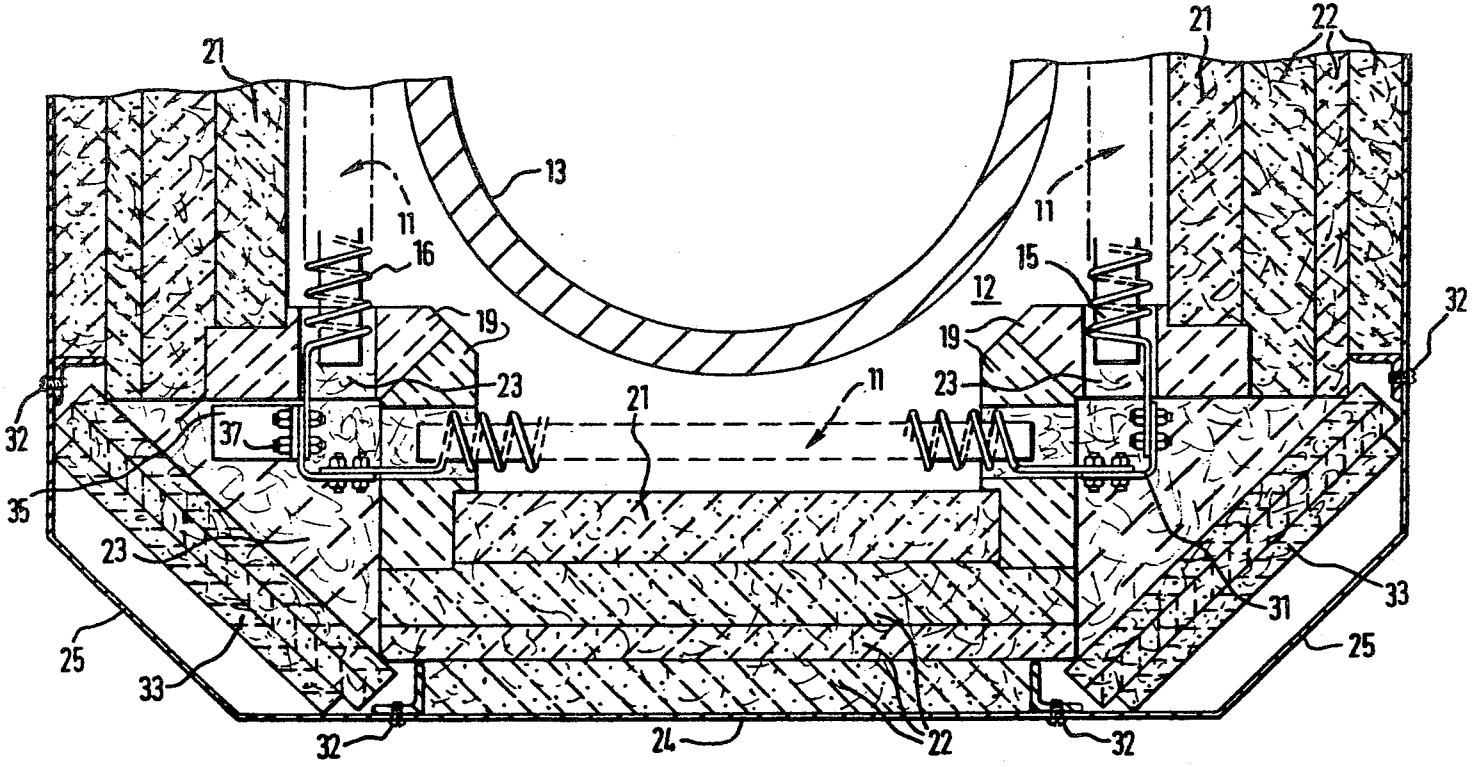
FIG. 1 is a diagrammatic plan view of a part of one form of electrical resistance furnace according to the present invention.
Figure 2:
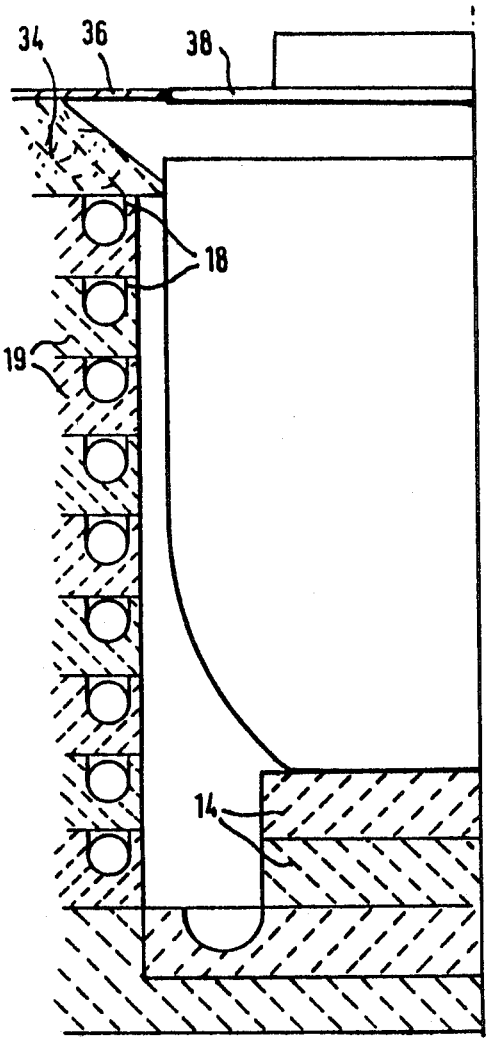
FIG. 2 is a diagrammatic vertical part-section.
Figure 3:
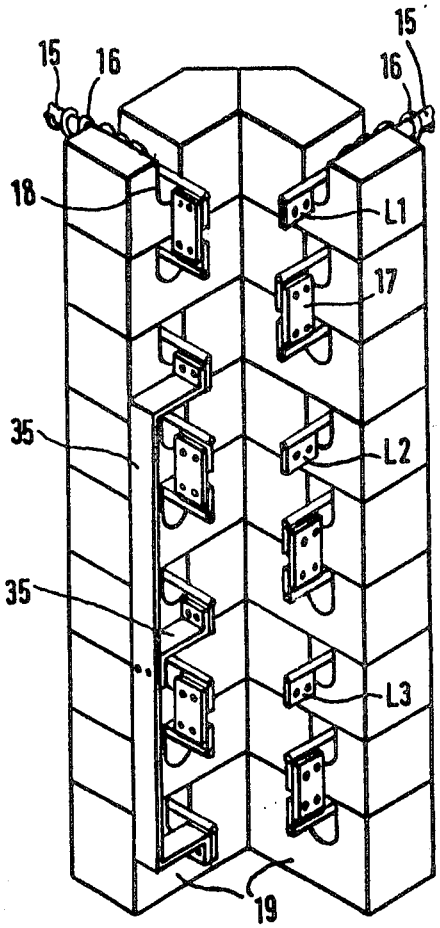
FIG. 3 shows a detail of a corner fire-brick.
Figure 4:
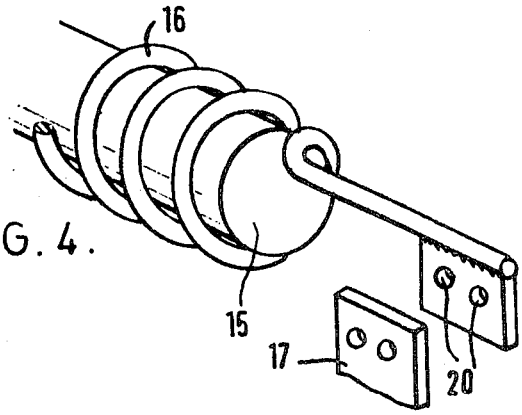
FIG. 4 shows a detail of one end of an electrical resistance heating element.

In carrying the invention into effect according to one convenient mode by way of example, an electrical resistance furnace includes a number of electrical resistance heating elements 11 arranged with their axes horizontally around a space 12 containing a crucible 13 resting upon fire-bricks 14.

Each resistance element consists of a ceramic tube 15 upon which is wound a conductor 16 welded at each end to a plate 17, having holes 20 for bolts 37, so that in the region of the plate 17 the current-carrying capacity of the conductor 16 is greatly increased to insure that the minimum of heat is generated in this region.

The elements 11 are supported at each end by corner fire-bricks 19, stacked one upon each other with the end wound turns of the conductors 16 resting in U-shaped grooves 18 in the fire-bricks 19. The ends of the tubes 15 extend beyond the end wound turns of the conductors 16 but do not extend through the fire-bricks 19 to the exterior. Beyond the end wound turns the conductors extend to the exterior where they are connected to the plates 17. Normally the elements have a 3-phase star or delta connection formed by means of links 35 and one or two of the four corners of the furnace are arranged for external connection to the electrical power supply. At the other two or three corners, adjacent ends of the elements are interconnected by links 31 as in FIG. 1.

The elements 11 are surrounded by heat insulation in the form of pre-formed calcium silicate boards 21 extending between the corner fire-bricks 19 and these are backed up by further calcium silicate boards 22.

In turn, these components are encased in a metallic outer casing 24 having removable corner covers secured by screens 32 and corner calcium silicate boards 33 are provided inside the corners 25 to complete the heat insulation. The casing is completed by top cover 36 having a removable lid 38.

Inside the corner boards 33 there is provided ceramic wool fibre 23 which is also inserted in the grooves 19 around the ends of the conductors 16 and tubes 15. A heat insulating fillet 34 rests upon the top of the corner fire-bricks 19 and the top of the boards 21 and engages the side of the crucible 13 so as to provide a reasonable seal for space 12 assisted by the fibre 23 in the grooves 18.

It will be appreciated that with this arrangement, should any element 11 need replacing then all that is necessary is to let the furnace cool for a short while and then remove the appropriate two corner covers 25 and corner heat insulation 33 and 23.

This will permit access to the electrical connections at both ends of the faulty elements so that the element ca be disconnected and withdrawn from the furnace and repaired or replaced without needing to gain access to the interior of the furnace. This operation may thus be performed and the furnace started up again in a much shorter period of time when compared with conventional furnaces, thus saving possibly a number of days interruption in the use of the furnace.

In some cases, if appropriate electrical connections can be provided, it may be sufficient to gain access to only one end of each resistance element.

I claim:

1. An electrical resistance furnace comprising:

(a) an outer casing having four removable corner covers, (b) corner fire-brick supports located in the casing adjacent its corners and having support apertures, (c) a plurality of electrical resistance heating elements, each comprising a conductor wound upon a ceramic tube and having plates welded to both ends of the conductor, (d) the heating elements extending horizontally between adjacent corner supports with the ends of the tubes supported in said support apertures in the corner supports and the plates located outside the corner supports, (e) electrical connections between the plates, (f) a crucible surrounded on all four sides by the heating elements, (g) heat insulation located between the outer casing and the heating elements so as to surround the heating elements, (h) said heat insulation having removable corner portions, and (i) the arrangement being such that by removal of the appropriate corner covers of the casing and the corner portions of the insulation access may be gained from the exterior of the furnace to the said electrical connections and to both ends of any element to permit removal of the element.

2. An electrical resistance furnace as claimed in claim 1, wherein the regions where the ends of the elements pass through the fire-brick material and the region between the top of the heat insulation and near the top of the crucible are sealed to enclose the space surrounding the crucible.

3. An electrical resistance furnace as claimed in claim 1, wherein the furnace is provided with an outer casing having four removable corner covers covering removable heat insulation so that both may be removed to gain access to the ends of the elements at each corner.

* * * * *